United States Patent [19]

Howard et al.

[11] Patent Number: 5,063,638

[45] Date of Patent: Nov. 12, 1991

[54] HINGE ASSEMBLY

[75] Inventors: John R. Howard, West Chicago; Charles E. Nichols, Woodridge, both of Ill.

[73] Assignee: Sterling Plumbing Group, Inc., Schaumburg, Ill.

[21] Appl. No.: 568,935

[22] Filed: Aug. 17, 1990

[51] Int. Cl.[5] ..... E05D 7/04

[52] U.S. Cl. ..... 16/238; 16/240; 16/271; 16/291; 16/250; 49/398; 49/505; 52/217

[58] Field of Search ..... 16/240, 270, 271, 291, 16/250, 251, 235, 238; 49/381, 383, 398, 400, 505; 52/217

[56] References Cited

U.S. PATENT DOCUMENTS

| | | | |
|---|---|---|---|
| 539,741 | 5/1895 | Ingram . | |
| 1,724,186 | 8/1929 | Fox . | |
| 1,919,393 | 7/1933 | Reinhardt | 52/217 |
| 2,284,074 | 5/1942 | Stahl . | |
| 2,595,506 | 5/1952 | Backman . | |
| 2,739,674 | 3/1956 | Casebolt | 49/505 |
| 2,752,014 | 6/1956 | Watson . | |
| 2,768,410 | 10/1956 | Woodard . | |
| 2,834,066 | 5/1958 | Lybarger | 49/400 |
| 2,856,040 | 10/1958 | Dansereau . | |
| 2,866,997 | 1/1959 | Eskridge et al. . | |
| 3,390,486 | 7/1968 | Walters | 49/381 |
| 3,545,135 | 12/1970 | Lieber | 49/505 |
| 4,438,597 | 3/1984 | Maggart | 49/400 |
| 4,453,346 | 6/1984 | Powell et al. . | |
| 4,897,889 | 2/1990 | Baus | 49/383 |

*Primary Examiner*—Lowell A. Larson
*Assistant Examiner*—Thomas C. Schoeffler
*Attorney, Agent, or Firm*—Quarles & Brady

[57] ABSTRACT

A hinge assembly is disclosed. A jamb cover of the assembly is adjustably mounted relative to a wall jamb. An adjuster sub-assembly is mounted within the jamb cover. The adjuster sub-assembly includes a bracket with a nut mounted thereon. An adjuster screw, the head of which is secured in a keyhole slot of the wall jamb, threadably engages the nut. A leaf spring is attached to the bracket, and a hinge member for the door extends through the jamb cover and contacts the leaf spring. The hinge is thus concealed from view.

12 Claims, 3 Drawing Sheets

FIG. 1
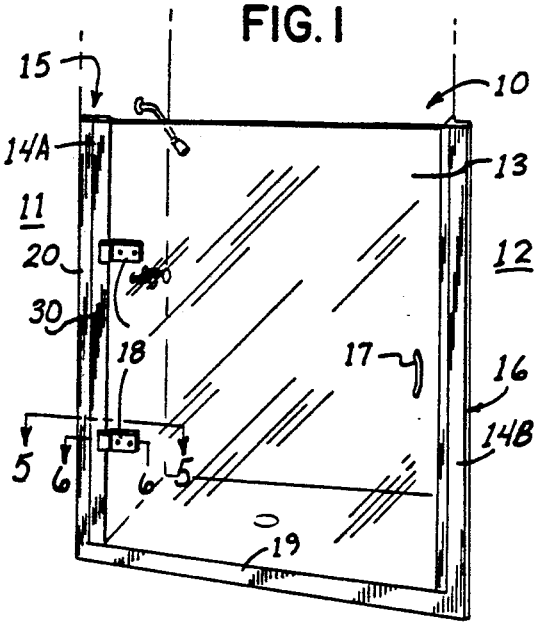
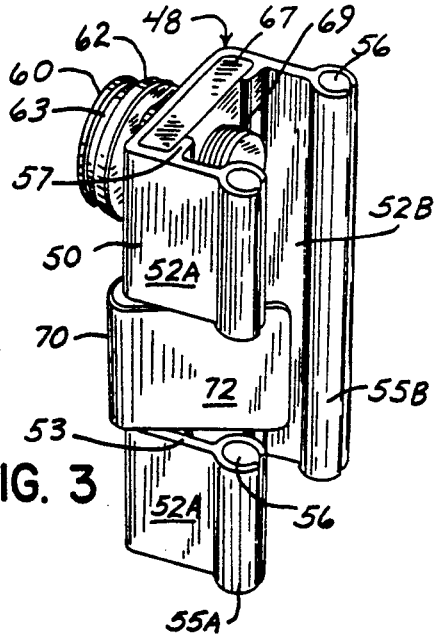
FIG. 3
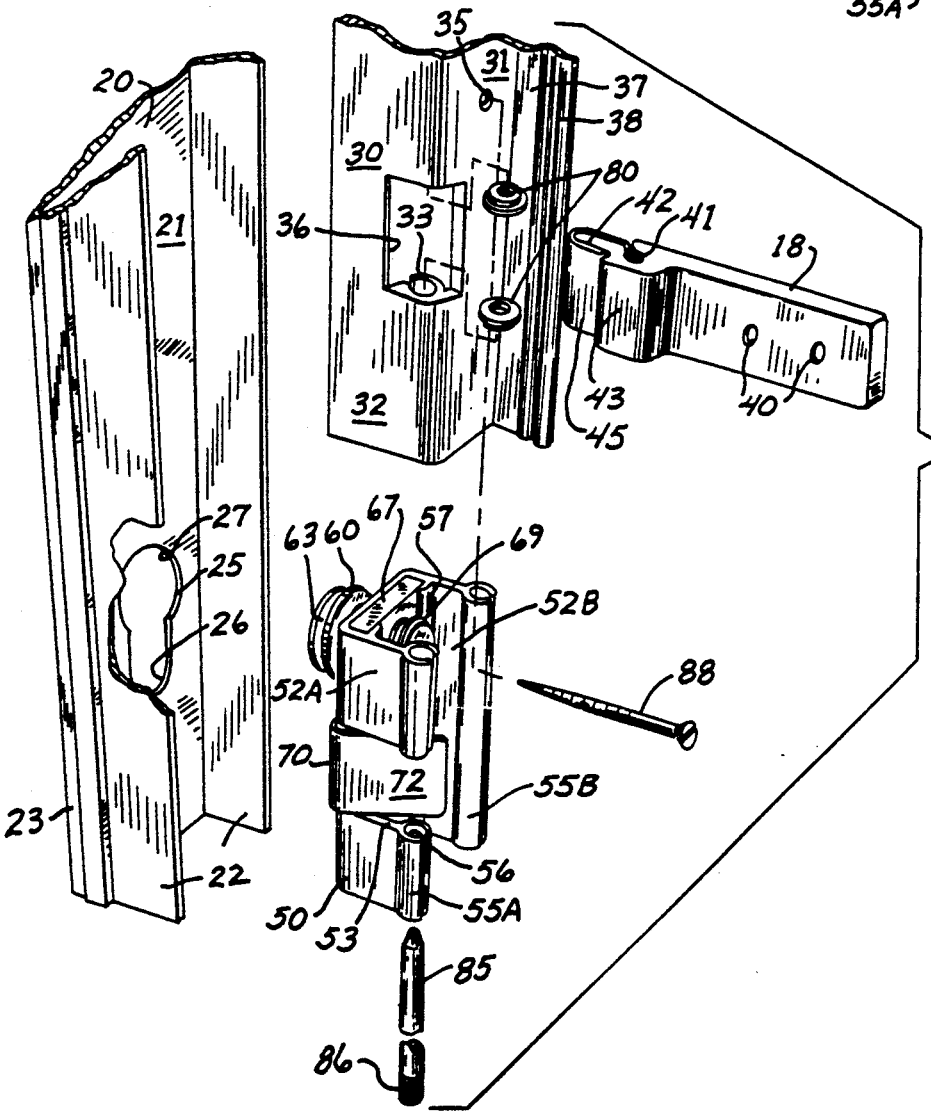
FIG. 4

FIG. 5
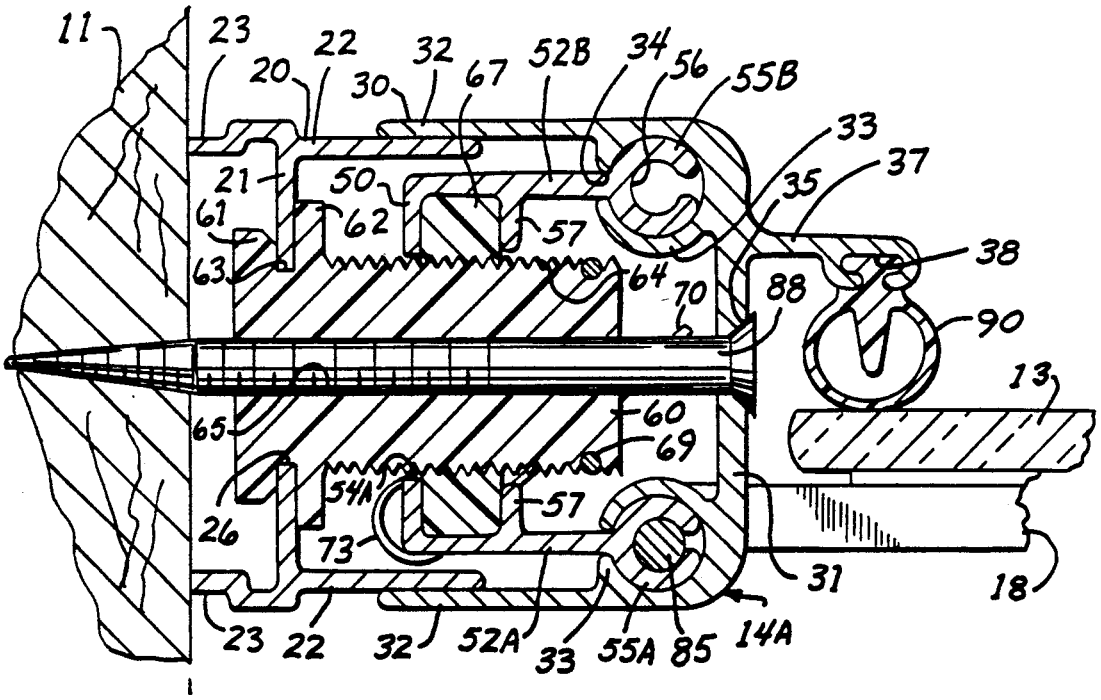
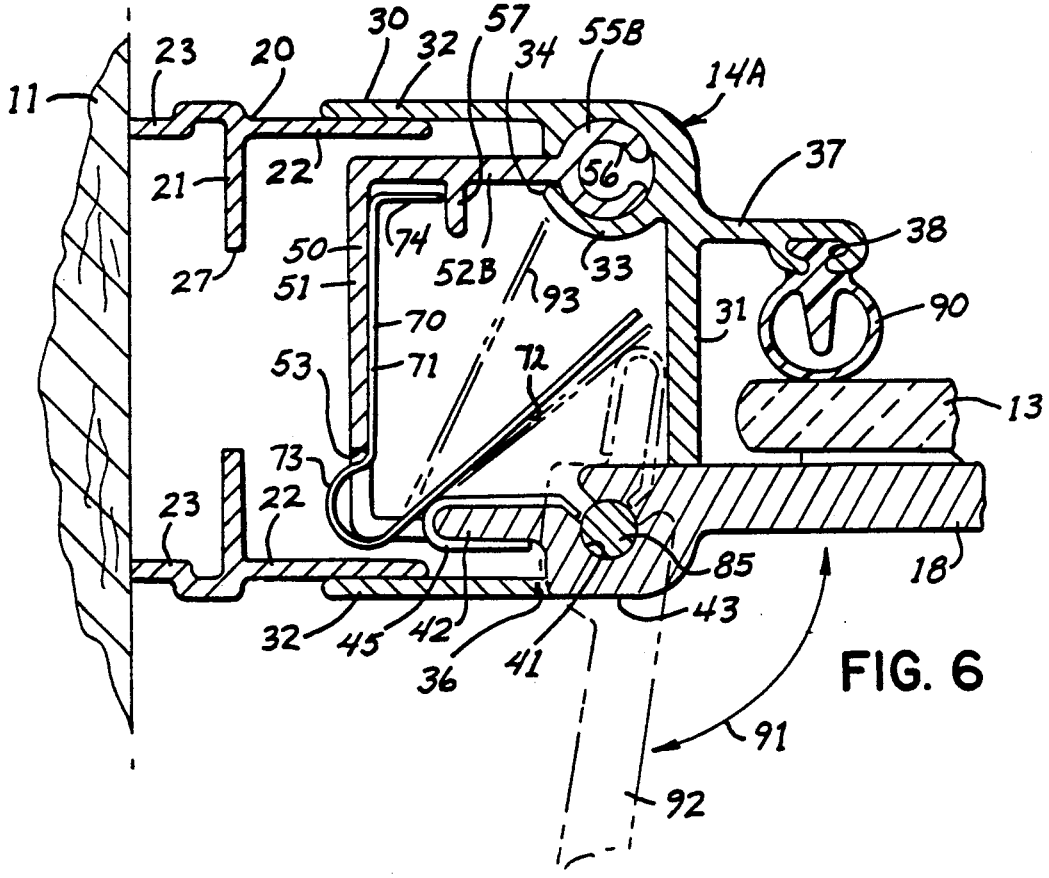
FIG. 6

HINGE ASSEMBLY

BACKGROUND OF THE INVENTION

1. Field Of The Invention

The present invention relates to a structure for mounting a door (e.g., a shower or closet door). More particularly, it pertains to a concealed hinge that can easily be adjusted to compensate for an out-of-plumb wall and that biases the door toward either a fully open or fully closed position.

2. Description Of Related Art

Doors for shower stalls and entryways are frequently mounted using vertical hinges. A problem commonly arises in that the doors are built to a standard size and the surrounding walls are out-of-plumb. When a door is positioned in an out-of-plumb wall structure, one portion of the door may fit properly, while another portion gaps away from the wall or scrapes against the door frame. For shower doors, this is especially undesirable as water may leak from the bathing area if gaps are left around the door.

Several vertical-hinge mounting structures are designed to compensate for out-of-plumb walls. See e.g., U.S. Pat. Nos. 2,284,074 and 2,595,506. However, the hinges in these structures are, unfortunately, exposed to view. Also, such mounting structures may incorporate a magnetic or mechanical latch to keep a door closed, but otherwise allow the door to swing freely. In other structures, such as shown in U.S. Pat. No. 539,741, a leaf spring is used to bias a door closed but the spring is exposed to view.

Thus, it can be seen that an improved hinge assembly is needed which can compensate for out-of-plumb walls and control the door position through the full range of motion, while at the same time concealing the unsightly operating components from view.

SUMMARY OF THE INVENTION

This invention provides a hinge assembly for mounting a door, such as a shower door. The hinge assembly includes a wall jamb and a jamb cover that is adjustably positionable relative to the wall jamb. The jamb cover has a body portion, flanges extending from the body portion, and a cut-out area. A bracket is positionable between the wall jamb and the jamb cover so as to be secured to the jamb cover. The bracket is adjustably mountable relative to the wall jamb. A hinge member of the apparatus is extendable through the cut-out area and is pivotally mountable relative to the jamb cover. A pivotal force is imparted on a control arm of the hinge member from between the wall jamb and the jamb cover.

In this way, the hinge assembly results in a structure for mounting a door that can be adjusted to compensate for an out-of-plumb wall. The wall jamb, which attaches to the wall, may be out-of-plumb. The position of the jamb cover relative to the wall jamb may be adjusted, however, to obtain the proper alignment of the door with respect to the wall structure. Furthermore, the hinge assembly controls the position of the door by imparting a pivotal force on the hinge member. The door is thus not allowed to swing freely when it is open.

In another aspect of the invention, a hinge assembly for mounting a door includes a wall jamb having a slot with a narrow portion and an enlarged portion. A jamb cover, which includes a cut-out area, is adjustably positionable relative to the wall jamb. A bracket with a screw hole is connectable to the jamb cover, and a leaf spring is positionable against the bracket. A nut is positionable against the bracket in line with the screw hole so that the bracket prevents rotation of the nut. An adjuster screw is positionable through the screw hole so as to threadably engage the nut. The adjuster screw has a shoulder, a head, and a collar groove formed between the shoulder and the head. The head is sized to pass through the enlarged portion but not through the narrow portion of the slot. The collar groove is positionable within the narrow portion of the slot after the head has been inserted through the enlarged portion. The hinge assembly also includes a hinge member that is extendable through the cut-out area of the jamb cover. The hinge member is pivotally mountable relative to the jamb cover so that a control arm of the hinge member is in contact with the leaf spring.

In this aspect of the invention, the collar groove of the adjuster screw is positionable within the slot of the wall jamb, while the threads of the adjuster screw are attached to the nut. The bracket, which retains the nut, is secured to the jamb cover. Thus, the position of the jamb cover relative to the wall jamb may be altered by changing the amount that the adjuster screw is inserted into the nut. The bracket, adjuster screw and nut are all concealed from view to give the hinge assembly an aesthetically pleasing streamlined exterior.

In another aspect of the invention, the leaf spring is positionable to bias the hinge member toward either a fully open position or a fully closed position. The concealed leaf spring thereby affects the position of the door, which is attached to the hinge member. Also, when the door is fully closed or fully open, the leaf spring imparts a holding force on the hinge member which tends to maintain the door in that position.

Thus, it is an object of the present invention to provide a hinge assembly for mounting a door that allows a door to be properly and easily positioned to compensate for an out-of-plumb wall.

It is another object of the invention to provide a hinge assembly for mounting a door where the position of the door is controlled through the full pivotal range of motion.

It is another object of the invention to provide a hinge assembly for mounting a door where the assembly imparts a holding force to normally maintain the door in either a fully open or a fully closed position.

It is another object of the invention to provide a hinge assembly for mounting a door where the unsightly operating components (i.e., the hinge and the structure for compensating for out-of-plumb wall conditions) are concealed from view.

It is another object of the invention to provide a hinge assembly for mounting a door that can be adapted to be used on both the hinge side and the strike side of a door.

It is still another object of the invention to provide a hinge assembly that is structurally and operationally uncomplicated, in order to minimize manufacturing costs and reduce installation time and effort.

The foregoing and other objects and advantages of the invention will be evident from the following description. In the description, reference is made to the accompanying drawings which form a part hereof, and in which there is shown by way of illustration a preferred embodiment of the invention. Such embodiment does not represent the full scope of the invention. Reference is therefore made to the claims herein for interpreting the scope of the invention.

BRIEF DESCRIPTION OF THE DRAWINGS

FIG. 1 is a view in perspective of a shower enclosure incorporating a hinge assembly according to the invention;

FIG. 3 is a view in perspective of a sub-assembly of the hinge assembly of FIG. 1;

FIG. 4 is a view similar to FIG. 2, but showing several components in a partially assembled form;

FIG. 5 is an enlarged view in horizontal section taken along line 5—5 of FIG. 1; and FIG. 6 is an enlarged view in horizontal section taken along line 6—6 of FIG. 1.

DETAILED DESCRIPTION OF THE PREFERRED EMBODIMENTS

Figure 2:
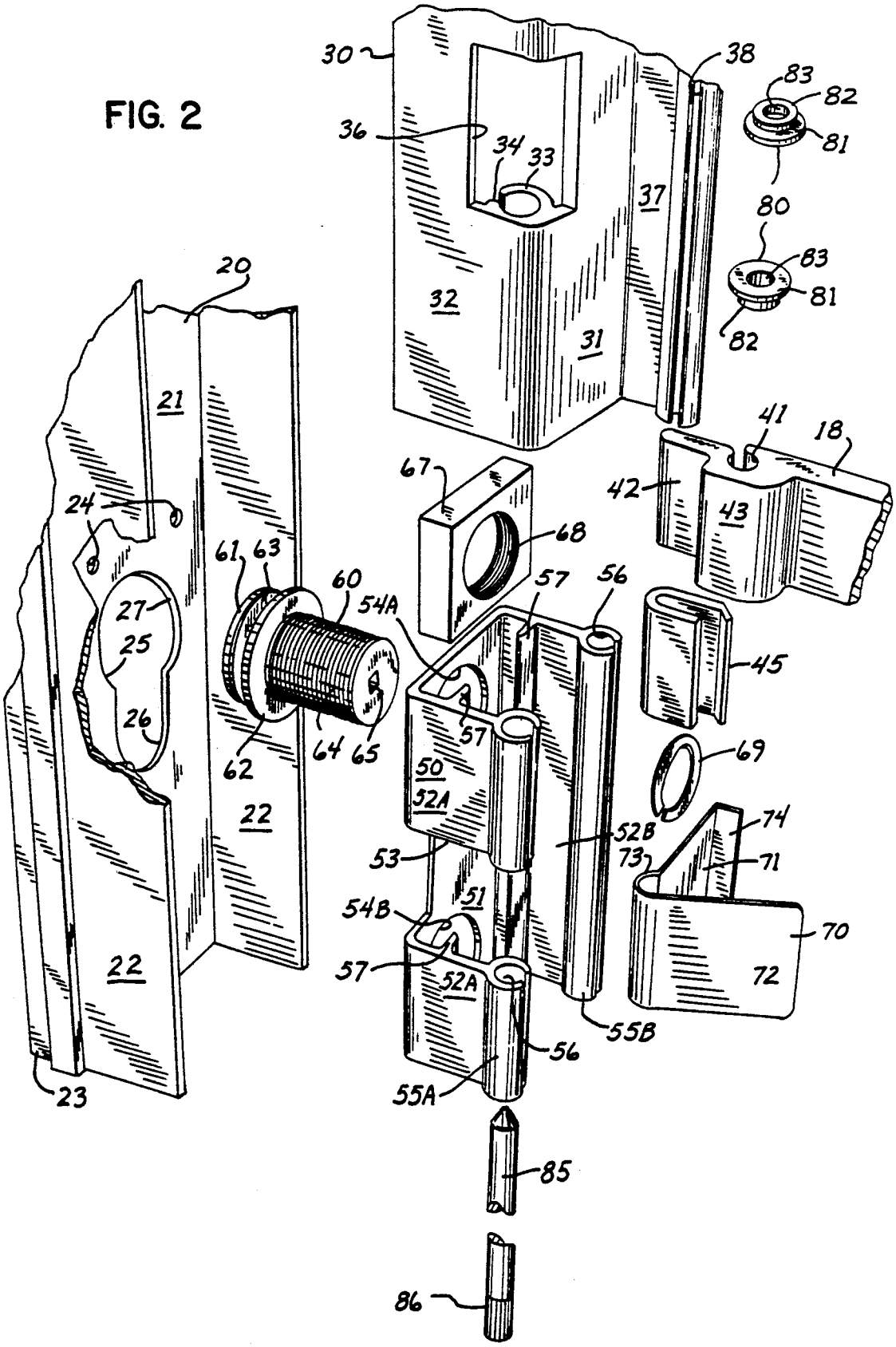
FIG. 2 is an exploded view in perspective (partially fragmented) of several components of the hinge assembly shown in FIG. 1.

Referring to FIG. 1, a shower area 10 is formed between two side walls 11 and 12. A front shower door 13 controls access to the shower area 10, and is attached to a hinge assembly 14A on a hinge side 15 of the door. The door is positioned against a similar (except as discussed below) hinge assembly 14B on a strike side 16. The door 13 is designed to be opened from the right side using a handle 17, although the hinge assemblies 14A and 14B may be assembled to permit the door to be opened from the left side. The shower door 13 is attached to a pair of hinge members 18 of the hinge assembly 14A. Assemblies 14A and 14B and the door 13 fit on a threshold 19 so as to prevent water from leaving the shower area 10 when the door is closed.

Several components of the hinge assembly 14A for the hinge side 15 of the shower door 13 are shown in FIG. 2. The hinge assembly 14A includes a wall jamb 20 having a main web portion 21. A pair of panels 22 extend in one direction from the web portion 21 and a pair of legs 23 (best shown in FIGS. 5 and 6) extend in an opposite direction. The web portion 21 includes a plurality of mounting holes 24 (only two shown in FIG. 2) for attaching the wall jamb 20 to the wall 11. A pair of keyhole slots 25 (only one shown), each having a narrow portion 26 and an expanded portion 27, are formed in the web portion 21. The keyhole slots 25 are spaced apart by a specified distance (center to center) and orientated so that the enlarged portions 27 of the slots are toward the same end of the wall jamb 20.

A jamb cover 30 has a body portion 31 with a pair of flanges 32 (best shown in FIGS. 5 and 6) extending from the body portion 31. Elongated sockets 33 having slits 34 are formed adjacent the intersection of the flanges 32 and the body portion 31. The sockets 33 and slits 34 preferably extend the full length of the jamb cover 30. The flanges 32 are spaced apart to allow the jamb cover 30 to be partially positioned over the panels 22 of the wall jamb 20, as shown in FIGS. 5 and 6.

The jamb cover 30 also includes a pair of countersunk fastener holes 35 (one seen in FIGS. 4 and 5) passing through the center of the body portion 31. A pair of cut-out areas 36 (one seen in FIGS. 2, 4 and 6) are formed in segments of the body portion 31 and one flange 32. The cut-out areas 36 interrupt the otherwise continuous sockets 33 formed in the jamb cover 30. Note that the cut-out areas 36 are preferably, although not necessarily, surrounded on all sides by portions of the jamb cover 30. One fastener hole 35 is paired with one cut-out area 36, as generally depicted in FIG. 4. The fastener hole/cut-out area pairs are spaced apart from one another by the same specified distance that the keyhole slots 25 of the wall jamb are spaced apart.

A longitudinal projection 37 extends perpendicularly from the body portion 31 and terminates in an integrally-formed guideway 38. The projection 37 is located off-center of the body portion 31, with the guideway 38 directed toward the center of the body portion (i.e., toward the fastener hole 35). Both the wall jamb 20 and the jamb cover 30 may be formed of a sturdy material, such as aluminum, which may be extruded for ease of manufacturing. The mounting holes 24, keyhole slots 25, fastener holes 35 and cut-out areas 36 may be formed after extrusion.

The shower door 13 is secured to the hinge members 18 using bolt holes 40 (FIG. 4) and a conventional fastener, although the door may be attached to the hinge members by any suitable method. Each hinge member 18 includes an arcuate mounting slot 41 and a control arm 42 adjacent the mounting slot 41. A smooth-contoured raised portion 43 of the hinge member 18 is also located adjacent the mounting slot 41. The width of the hinge member 18 (i.e., the length of slot 41) allows the hinge member 18 to fit in the cut-out area 36 of the jamb cover 30. A clip 45, preferably formed of a non-metal resilient material, is sized and shaped to resiliently attach to the control arm 42 of the hinge member 18.

The wall jamb 20 and the jamb cover 30 are maintained in position relative to one another by a pair of adjuster sub-assemblies 48 (one shown in FIG. 3). Each sub-assembly 48 includes a bracket 50 having a base 51 with walls 52A and 52B extending generally perpendicular to the base 51. A recessed section 53 interrupts one wall 52A and cuts into a portion of the base 51. The base 51 includes a pair of screw holes 54A and 54B located adjacent opposite ends of the bracket 50. The walls 52A and 52B terminate with integrally-formed guides 55A and 55B which are sized to fit in the sockets 33. Guide 55B extends the length of the bracket 50, while guide 55A is interrupted by the recessed section 53. The guides 55A and 55B have a C-shaped cross-section due to longitudinal openings 56 in the guides. Each bracket 50 also has a pair of inwardly-directed lips 57 which extend from the walls 52A and 52B.

The adjuster sub-assembly 48 also includes an adjuster screw 60, which may be made of a sturdy plastic material. The adjuster screw 60 is formed with a head 61, a shoulder 62, and a collar groove 63 between the head and the shoulder. The adjuster screw 60 also includes external threads 64 and a longitudinal central aperture 65. The central aperture 65 is preferably, although not necessarily, formed with a hexagonal or a square cross-section. The adjuster screw 60 is sized so that the threads 64, but not the shoulder 62, pass through the screw holes 54A and 54B of the bracket 50. The head 61 is sized to pass through the expanded portion 27 but not the narrow portion 26 of the keyhole slot 25. The shoulder 62 is preferably formed slightly larger than the head 61, so that it cannot pass through the expanded portion 27 of the keyhole slot 25. The collar groove 62 is sized so that it may be positioned in the narrow portion 26 of the keyhole slot 25 after the head 61 has passed through the expanded portion 27.

A nut 67 having internal threads 68 is designed to rotatably attach to the external threads 64 of the adjuster screw 60. The nut 67 is sized to fit squarely between the walls 52A and 52B of the bracket 50 (see FIG. 5) so that the nut 67 is prevented from rotating when positioned between the walls 52A and 52B. The nut 67 is also sized to fit between the base 51 and the inwardly extending lips 57 of the bracket 50. A locking ring 69 is designed to attach to the external threads 64 of the adjuster screw 60.

A leaf spring 70 of the adjuster sub-assembly 48 has a main surface 71 which is separated from an engagement surface 72 by a curved portion 73. A projection 74 extends perpendicularly from the main surface 71. The leaf spring 70 is sized appropriately to allow the main surface 71 to be positioned against the base 51 of the bracket 50 (see FIG. 6), with the projection 74 located against a wall 52B of the bracket 50. In this position, the projection 74 extends between the base 51 and a lip 57. The width of the leaf spring 70 is such that when the main surface 71 is positioned against the bracket 50, the engagement surface 72 and the curved portion 73 fit in the recessed section 53 of the bracket 50 (see FIGS. 3 and 6). The leaf spring 70 is preferably formed of a resilient metal material.

To construct and install the hinge assembly 14A for the hinge side 15 of the shower area 10, the wall jamb 20 is mounted against the wall 11. The wall jamb 20 is orientated so that the enlarged portions 27 of the keyhole slots 25 are above the narrow portions 26. As illustrated in FIGS. 5 and 6, the legs 23 contact the wall 11 and thereby separate the web portion 21 from the wall. The wall jamb 20 is secured to the wall by screws or other suitable means using the mounting holes 24.

Prior to attaching the jamb cover 30 to the wall jamb 20, the pair of adjuster sub-assemblies 48 (FIG. 3) are assembled and mounted in the jamb cover 30. To construct an adjuster sub-assembly, a nut 67 is positioned over screw hole 54A (hole 54B for reverse mounting) in the bracket 50. The nut 67 fits between the walls 52A and 52B and between the base 51 and the lips 57. An adjuster screw 60 is inserted through the screw hole 54A and threaded into the nut 67 (about half way). The adjuster screw 60 may be rotated by hand or by a tool (e.g., an Allen wrench or a screwdriver engaging the central aperture 65). Contact with the walls 52A and 52B prevents the nut 67 from rotating. At this time, a locking ring 69 may be attached to the external threads 64 of the adjuster screw 60 (see FIG. 5).

Construction of the adjuster sub-assembly 48 is completed by positioning a leaf spring 70 against the bracket 50. With the main surface 71 of the leaf spring 70 laying flat on the base 51 of the bracket 50, the projection 74 fits between the base 51 and a lip 57. The curved portion 73 and the engagement surface 72 are positioned in the recessed section 53 of the bracket 50. The main surface 71 of the leaf spring 70 is riveted or otherwise suitably fastened to the bracket 50.

Each adjuster sub-assembly 48 is mounted in the jamb cover 30 by inserting the guides 55A and 55B of the bracket 50 into the corresponding sockets 33 of the jamb cover 30. The guide 55A which is interrupted by the recessed section 53 is inserted into the socket 33 which is interrupted by the cut-out area 36. The walls 52A and 52B of the bracket 50 are accommodated by the slits 34 of the sockets 33. Note that the bracket 50 could engage the jamb cover 30 by means other than the guides 55A and 55B and sockets 33 that are shown. The brackets 50 are slidably positioned within the jamb cover 30 so that the recessed section 53 is aligned with one of the cut-out areas 36.

With the adjuster sub-assemblies 48 in place, a pair of bushings 80 are inserted into the exposed sockets 33 adjacent the cut-out areas 36 (as suggested in FIG. 4). The bushings 80 have a head portion 81 and an axially extending flange 82. The flange 82 is sized to fit within the sockets 33, while the head portion 81 resides outside the sockets 33. The recessed portion 53 of the bracket 50 is preferably sized to allow the flanges 82 of the bushings 80 to fit within the sockets 33 when the recessed portion 53 is aligned with a cut-out areas 36. A central longitudinal bore 83 of each bushing 80 has an inside diameter approximately the same as that of the longitudinal openings 56 of the bracket guides 55A and 55B.

With the clips 45 attached to the two hinge members 18, each hinge member 18 is positioned in a cut-out area 36 between the bushings 80. The mounting slot 41 of the hinge member 18 aligns longitudinally with the sockets 33 of the jamb cover 30. The control arm 42 is thus positioned within the jamb cover 30, while the portion of the hinge member 18 with the bolt holes 40 is positioned outside the jamb cover 30. As shown in FIG. 6, the clip 45 is in contact with the engagement surface 72 of the leaf spring 70.

Each hinge member 18 is mounted using a hinge pin 85 that is sized to partially fit within the longitudinal openings 56 of the bracket 50. The hinge pin 85 is inserted into the socket 33 that is interrupted by the cut-out area 36. The hinge pin 85 is then caused to enter guide 55A so that it passes through the mounting slot 41 of the hinge member 18. In this way, the hinge member 18 is pivotally mounted relative to the bracket 50 and the jamb cover 30. Each hinge pin 85 has a radially-extending splined portion 86 which, when encountering the guide 55A, creates a force fit between the pin 85 and the bracket 50. With the hinge pin 85 frictionally engaging the guide 55A, the bracket 50 is maintained in a generally fixed position relative to the jamb cover 30.

The jamb cover 30 is then secured on the wall jamb 20 by mounting the adjuster screws 60 in the keyhole slots 25. The head 61 of each adjuster screw 60 is inserted through the expanded portion 27 until the shoulder 62 encounters the web portion 21. The legs 23 of the wall jamb 20 separate the web portion 21 from the wall 11 and thereby create room for the head 61 (see FIG. 5). The collar groove 63 is then properly positioned to be slid into the narrow portion 26 of the keyhole slot 25. Both adjuster screws 60 are slid downwardly into the keyhole slots 25 simultaneously. The jamb cover 30 is preferably shorter than the height of the shower area 10 to allow for vertical movement of the jamb cover 30 relative to the wall jamb 20 during mounting. The shower door 13 is connected to the hinge members 18 using the bolt holes 40.

The hinge assembly 14A may be adjusted for an out-of-plumb wall 11 by changing the amount that the adjuster screws 60 are inserted into the nuts 67. To access the adjuster screws 60, one need only lift up on the jamb cover 30. This causes the adjuster screws 60 to move from the narrow portion 26 to the enlarged portion 27 of each keyhole slot 25. Moving the jamb cover 30 away from the wall jamb 20 causes the screw head 61 to exit the keyhole slot 25.

With the jamb cover 30 separated from the wall jamb 20, the adjuster screws 60 may be rotated to compensate for an out-of-plumb wall 11. By inserting the upper adjuster screw 60 further into the nut 67, the top portion of the jamb cover 30 will be mounted closer to the top portion of the wall jamb 20. Conversely, by backing the upper adjuster screw 60 out of the nut 67 somewhat, the top portion of the jamb cover will be mounted further away from the top portion of the wall jamb 20. Note that the locking rings 69 prevent the adjuster screws 60 from completely disengaging the nuts 67. By coordinating adjustment of the top and bottom adjuster screws 60, the hinge assembly 14A on the hinge side 15 of the shower door 13 may be adjusted to compensate for out-of-plumb walls 11 or 12.

When the jamb cover 30 is in the desired position relative to the wall jamb 20, a final screw-type fastener 88 is attached to the wall 11. As shown in FIG. 5, the fastener 88 passes through the fastener hole 35 in the jamb cover 30 and through the central aperture 65 of the adjuster screw 60. The fastener 88 secures the hinge assembly 14A together to avoid unintentional disassembly.

The hinge assembly 14B for the strike side 16 of the door 13 is assembled and installed in a similar manner. The strike side hinge assembly 14B includes the components necessary to adjust for an out-of-plumb wall 12, but does not include the hinge mechanism to mount the shower door 13. Thus, a jamb cover 30 for the strike side 16 is preferably formed without the cut-out areas 36. Similarly, the adjuster sub-assembly 48 for the strike side 16 does not require the leaf spring 70.

To install the hinge assembly 14B for the strike side 16, the wall jamb 20 is secured to the wall 12. The adjuster screws 60 and nuts 67 are connected through a screw hole 54A or 54B of the bracket 50. Two brackets 50 are inserted into the sockets 33 of the jamb cover 30 so that the central aperture 65 of each adjuster screw 60 is aligned with a fastener hole 35. The position of the adjuster screws 60 corresponds to the position of the keyhole slots 25 in the wall jamb 20. The sockets 33 are crimped or deformed to secure the brackets 30 to the jamb cover 30, although other means of attachment are possible. The jamb cover 30 is mounted so that the guideway 38 on the projection 37 faces away from the shower area 10. The adjuster screws 60 are inserted into the keyhole slots 25, and the position of the adjuster screws 60 may be modified to compensate for an out-of-plumb wall 12. When the desired position is established, a fastener 88 is inserted through the fastener hole 35 and central aperture 65 and mounted in the wall 12.

The hinge assemblies 14A and 14B allow the shower door 13 to be properly mounted even when the walls 11 and 12 may be out-of-plumb. A seal member 90 is mounted in the guideways 38 of both hinge assemblies 14A and 14B to provide a water seal between the door 13 and the hinge assemblies when the door is closed. As shown in FIGS. 5 and 6, the seal 90 contacts the shower door 13 when the door is closed. The proper alignment of the door 13 in combination with the seal 90 prevents water from leaking past the hinge and strike side edges of the closed door.

The leaf springs 70 advantageously impart a force on the door 13 tending to keep the door closed. The hinge members 18 are pivotable about the hinge pin 85 through an arc (shown by arrow 91 of FIG. 6) between a closed position and an open position (illustrated by dashed lines 92). When the hinge members 18 are in the closed position, the shower door 13 is closed and the seal 90 minimizes water leakage. The engagement surface 72 of each resilient leaf spring 70 presses against the clip 45 thus providing a holding force to maintain the hinge member 18 and the door 13 in the closed position. At all times, the leaf spring 70 is generally concealed from view within the jamb cover 30. Note also that when the shower door 13 is closed, the raised portion 43 of the hinge member 18 provides a smooth exterior appearance to the hinge assembly 14A.

The leaf spring 70 also tends to affect the position of the shower door 13 throughout the full range of movement. The leaf spring 70 contacts the clip 45, and thus imparts a force on the control arm 42, over the full pivotal range of the door. For example, if the door 13 is opened slightly, the leaf spring 70 continues to apply a force on the hinge member 18 that tends to close the door. The leaf spring 70 will tend to close the door 13 until the spring reaches a center position 93, where the force from the leaf spring is perpendicular to the longitudinal axis of the hinge pin 85. If the door 13 is opened beyond the center position 93, the leaf spring 70 will impart a force on the hinge member 18 that tends to pivot the hinge member 18 and the door 13 toward the open position 92. When the hinge member 18 and the door 13 reach the open position 92, the leaf spring 70 continues to press against the clip 45 and control arm 42 to maintain the door open, until sufficient force is applied to begin to close the door. Note that other structures (not shown) such as a movable plate controlled by a coil spring, for example, could be substituted for the leaf spring 70.

The shower door 13 may be mounted to open from the left side rather than the right side (as shown in FIG. 1), by reversing orientation of the mounting components. The second screw hole 54B of the bracket 50 is provided for this purpose. The bracket 50 can then be mounted so that the adjuster screw 60 is above the recessed section 53, wall 52B of the bracket 50 is toward the shower area 10, and wall 52A is away from the shower area 10.

The foregoing detailed description has been for the purpose of illustration. Thus, a number of modifications and changes may be made without departing from the spirit and the scope of the present invention. For example, the nut 67 could be integrally formed with the bracket 50. Likewise, the bracket 50 could be integrally formed as part of the jamb cover 30. Therefore, the invention should not be limited by the specific embodiment described, but only by the claims.

We claim:

1. A hinge assembly for mounting a door, comprising:

a wall jamb;

a jamb cover adjustably positioned relative to the wall jamb, the jamb cover having a body portion, flanges extending from the body portion, and a cut-out area;

a bracket positioned between the wall jamb and jamb cover so as to be secured to the jamb cover and shrouded thereby;

means connected to the bracket for adjustably mounting the bracket relative to the wall jamb;

a hinge member extending through the cut-out area and being pivotally mounted relative to the jamb cover, the hinge member having a control arm extending between the wall jamb and jamb cover;

resilient means positioned between the wall jamb and jamb cover for contacting the control arm for imparting a pivotal force on the hinge member, said resilient means and control arm being shrouded by said jamb cover.

2. The hinge assembly of claim 1, wherein the means for imparting a pivotal force includes a leaf spring positionable against the bracket.

3. The hinge assembly of claim 2, wherein the means for adjustably mounting the bracket includes an adjuster screw threadably engaging a nut.

4. A hinge assembly for mounting a door, comprising:

a wall jamb having a slot with a narrow portion and an enlarged portion;

a jamb cover adjustably positionable relative to the wall jamb, the jamb cover having a cut-out area;

a bracket connectable to the jamb cover, the bracket having a screw hole;

a leaf spring positionable against the bracket;

a nut positionable against the bracket in line with the screw hole, the bracket preventing rotation of the nut;

an adjuster screw positionable through the screw hole so as to threadably engage the nut, the adjuster screw having a shoulder, a head and a collar groove formed between the shoulder and the head, the head being sized to pass through the enlarged portion but not through the narrow portion of the slot, the collar groove positionable within the narrow portion after the head has been inserted through the enlarged portion; and a hinge member extendable through the cut-out area and pivotally mountable relative to the jamb cover so that a control arm of the hinge member contacts the leaf spring.

5. The hinge assembly of claim 4, wherein the leaf spring is positionable to bias the hinge member toward either a fully open position or a fully closed position.

6. The hinge assembly of claim 5, wherein the door is attachable to the hinge member.

7. The hinge assembly of claim 6, wherein the jamb cover has a projection with a guideway for mounting a seal, the seal contacting the door when the hinge member is in the fully closed position.

8. The hinge assembly of claim 4, wherein the jamb cover has a body portion with flanges extending therefrom.

9. The hinge assembly of claim 8, wherein the wall jamb includes a pair of panels, and the flanges of the jamb cover are positionable outward of the panels.

10. The hinge assembly of claim 8, wherein:

the jamb cover includes longitudinally-extending sockets that are formed adjacent the body portion; and the bracket has a base with opposite walls extending therefrom, guides are formed on the walls remote from the base, and the guides are positionable in the sockets of the jamb cover.

11. The hinge assembly of claim 10, wherein:

the guides of the bracket have longitudinal openings;

the hinge member has a mounting slot that is alignable with the longitudinal openings; and a hinge pin is positionable in a longitudinal opening so as to pass through the mounting slot and pivotally mount the hinge member.

12. The hinge assembly of claim 10, wherein:

the walls have inwardly-extending lips; and the nut is positionable between the walls and between the base and the lips.

* * * * *